US010136766B2

(12) United States Patent
Fortman

(10) Patent No.: US 10,136,766 B2
(45) Date of Patent: Nov. 27, 2018

(54) SHOWER BENCH SEAT

(71) Applicant: Christopher J. Fortman, Kalida, OH (US)

(72) Inventor: Christopher J. Fortman, Kalida, OH (US)

( * ) Notice: Subject to any disclaimer, the term of this patent is extended or adjusted under 35 U.S.C. 154(b) by 0 days.

(21) Appl. No.: 15/521,381

(22) PCT Filed: Dec. 16, 2016

(86) PCT No.: PCT/US2016/067190
§ 371 (c)(1),
(2) Date: Apr. 24, 2017

(87) PCT Pub. No.: WO2017/106653
PCT Pub. Date: Jun. 22, 2017

(65) Prior Publication Data

US 2017/0303747 A1 Oct. 26, 2017

Related U.S. Application Data

(60) Provisional application No. 62/268,696, filed on Dec. 17, 2015.

(51) Int. Cl.

| | |
|---|---|
| ***A47K 3/28*** | (2006.01) |
| ***A47K 3/12*** | (2006.01) |
| ***A47K 3/30*** | (2006.01) |
| ***A47K 3/38*** | (2006.01) |

(52) U.S. Cl.
CPC ..... *A47K 3/282* (2013.01); *A47K 3/12* (2013.01); *A47K 3/122* (2013.01); *A47K 3/30* (2013.01); *A47K 3/38* (2013.01)

(58) Field of Classification Search
CPC ..... A47K 3/282
USPC ..... 4/578.1
See application file for complete search history.

(56) References Cited

U.S. PATENT DOCUMENTS

| | | | | |
|---|---|---|---|---|
| 4,472,844 A * | 9/1984 | Mace | ..... | A47K 3/122 4/579 |
| 5,361,428 A | 11/1994 | Nanowsky et al. | | |
| 5,561,868 A | 10/1996 | Campbell | | |
| 6,039,403 A | 3/2000 | Hargroder | | |

(Continued)

FOREIGN PATENT DOCUMENTS

| | | |
|---|---|---|
| ES | 249320 U | 6/1980 |
| GB | 2522209 A | 1/2014 |

OTHER PUBLICATIONS

PCT Search Report and Written Opinion, Application No. PCT/US/16/67190, filed Dec. 16, 2016.

*Primary Examiner* — Lauren Crane
(74) *Attorney, Agent, or Firm* — MacMillan, Sobanski & Todd, LLC

(57) ABSTRACT

A shower bench seat configured for use in a shower area is provided. The shower bench seat including an inboard assembly configured for placement within the shower area and an outboard assembly configured for placement adjacent the shower area. An intermediate assembly is configured to connect the inboard assembly to the outboard assembly. The intermediate assembly is further configured to retain a shower curtain within the shower area thereby facilitating use of the shower bench seat by a user in a seated position and simultaneously facilitating retention of water within the shower area.

20 Claims, 6 Drawing Sheets

(56) References Cited

U.S. PATENT DOCUMENTS

| | | | | |
|---|---|---|---|---|
| 7,690,055 | B2 | 4/2010 | Hammer et al. | |
| 8,181,285 | B1 * | 5/2012 | Jackson | A47K 3/122 297/16.1 |
| 2008/0052814 | A1 | 3/2008 | Kaiwai | |

* cited by examiner

SHOWER BENCH SEAT

BACKGROUND

Home health care products can include equipment and assistive devices for assisting invalid and/or aging persons in completing necessary tasks to go through everyday life. Non-limiting examples of home health care products include wheelchairs, oxygen concentrators, walkers, safety rails, gripping devices, blood pressure monitors, pill dispensers and the like. Often the home health care products are designed to prevent falls by the user, thereby improving the safety of the user and reducing the incidence of injury.

Another example of a home health care product that is used by invalid and/or aging persons is a shower bench seat (also commonly called a transfer bench). A shower bench seat is configured to allow a user to be positioned in a sitting orientation while taking a shower. In certain instances, the area comprising the shower can be defined, in part, by a bathtub. Typically, a shower bench seat includes a seating structure that is supported by legs disposed on both the inside and outside of shower (or legs disposed on both the inside and outside of the bathtub. This shower bench seat structure allows a user to initially sit down on the bench on the outside of the shower (bathtub), lift his or her legs over the edge of the shower (bathtub) while remaining in a seated orientation on the shower bench, and then slide himself or herself along the seat of the shower bench into the shower (bathtub). This shower bench seat structure improves the safety of the user as the user does not need to raise his or her legs while in a standing orientation in order to step over the edge of the shower (bathtub) to get into the shower (bathtub).

The shower (bathtub) can include a shower curtain, configured to retain water within the shower (bathtub). In certain instances where a shower bench seat is used, the shower curtain may not be able to retain water within the shower (bathtub) as the shower bench may not be configured for passage of the shower curtain below the bottom of the seat. As a result, the water within the shower (bathtub) can flow from the shower and onto the floor on the outside of the shower (bathtub), thereby creating a potential slipping hazard.

It would be advantageous if shower bench seats for showers could be improved to make them more convenient to use.

SUMMARY

It should be appreciated that this Summary is provided to introduce a selection of concepts in a simplified form, the concepts being further described below in the Detailed Description. This Summary is not intended to identify key features or essential features of this disclosure, nor is it intended to limit the scope of the shower bench seat.

The above objects as well as other objects not specifically enumerated are achieved by a shower bench seat configured for use in a shower area. The shower bench seat including an inboard assembly configured for placement within the shower area and an outboard assembly configured for placement adjacent the shower area. An intermediate assembly is configured to connect the inboard assembly to the outboard assembly. The intermediate assembly is further configured to retain a shower curtain within the shower area thereby facilitating use of the shower bench seat by a user in a seated position and simultaneously facilitating retention of water within the shower area.

There is also provided a method of using a shower bench seat configured for use in a shower area. The method includes the steps of positioning a substantial portion of an inboard assembly within the shower area, positioning an outboard assembly adjacent to the shower area, connecting the inboard assembly to the outboard assembly with an intermediate assembly, the intermediate assembly positioned within the shower area and inserting a portion of a shower curtain into the intermediate assembly such that the shower curtain extends across a shower opening and a user can use the shower bench seat in a seated position.

Various objects and advantages of the shower bench seat will become apparent to those skilled in the art from the following detailed description, when read in light of the accompanying drawings.

DETAILED DESCRIPTION OF THE INVENTION

The shower bench seat will now be described with occasional reference to specific embodiments. The shower bench seat may, however, be embodied in different forms and should not be construed as limited to the embodiments set forth herein. Rather, these embodiments are provided so that this disclosure will be thorough and complete, and will fully convey the scope of the shower bench seat to those skilled in the art.

Unless otherwise defined, all technical and scientific terms used herein have the same meaning as commonly understood by one of ordinary skill in the art to which the shower bench seat for a shower belongs. The terminology used in the description of the shower bench seat is for describing particular embodiments only and is not intended to be limiting of the shower bench seat. As used in the description of the shower bench seat and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the shower bench seat. Notwithstanding that the numerical ranges and parameters setting forth the broad scope of the shower bench seat are approximations, the numerical values set forth in the specific examples are reported as precisely as possible. Any numerical values, however, inherently contain certain errors necessarily resulting from error found in their respective measurements.

The description and figures disclose a shower bench seat. Generally, the shower bench seat is configured for placement such that portions of the shower bench seat are located within the shower area and other portions of the shower bench seat extend outward of the shower area. The shower bench seat is further configured to include gaps formed between extension members, with the gaps arranged to receive a portion of a shower curtain. With a portion of the shower curtain positioned within the gaps formed by the extension members, the shower curtain can be closed, that is, the shower curtain can extend across an opening to the shower area, such as to close off the opening and retain water within the shower area.

The term "shower area", as used herein, is defined to mean any place in which a person bathes under a spray of typically warm or hot water.

Figure 1:
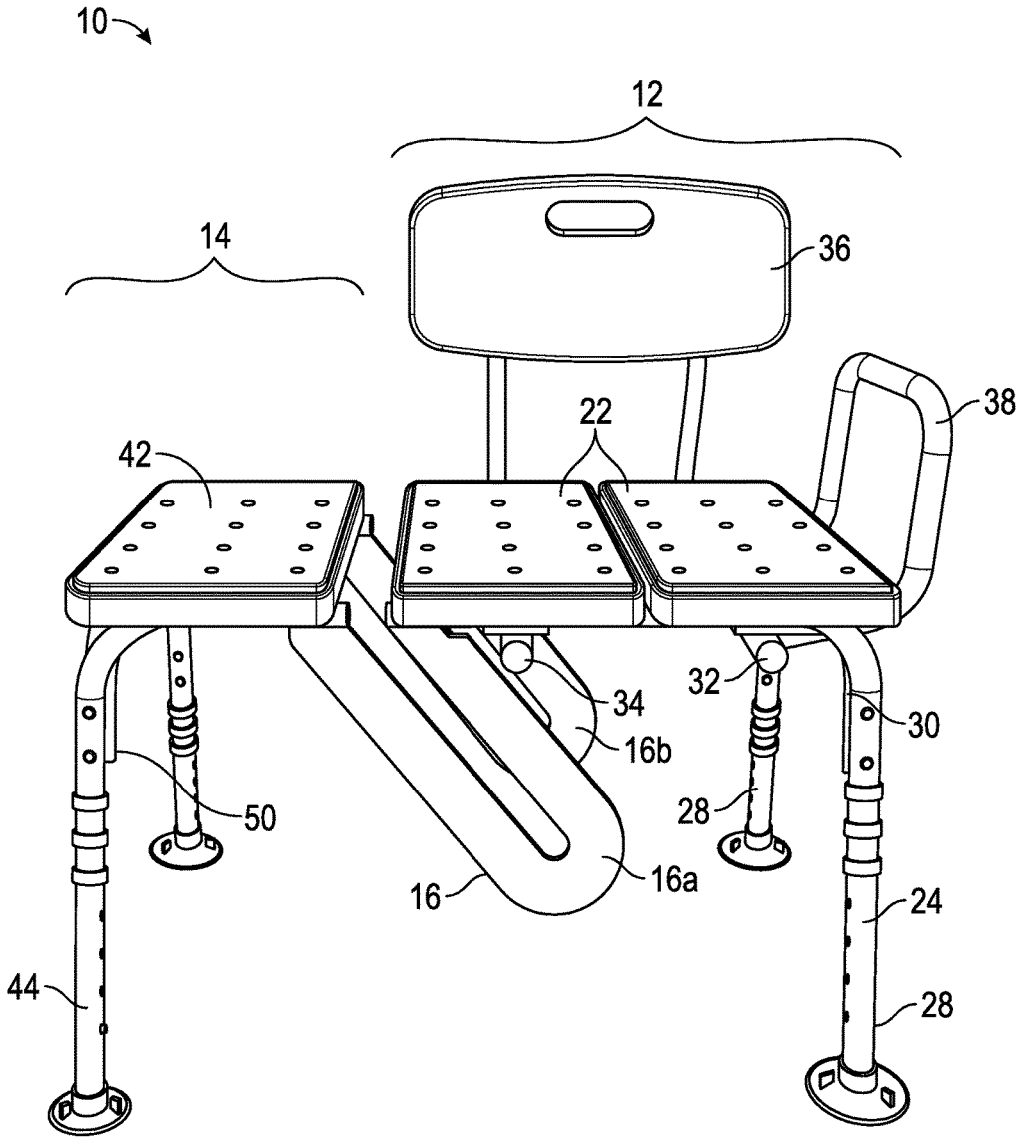
FIG. 1 is a perspective view of a shower bench seat.
Figure 2:
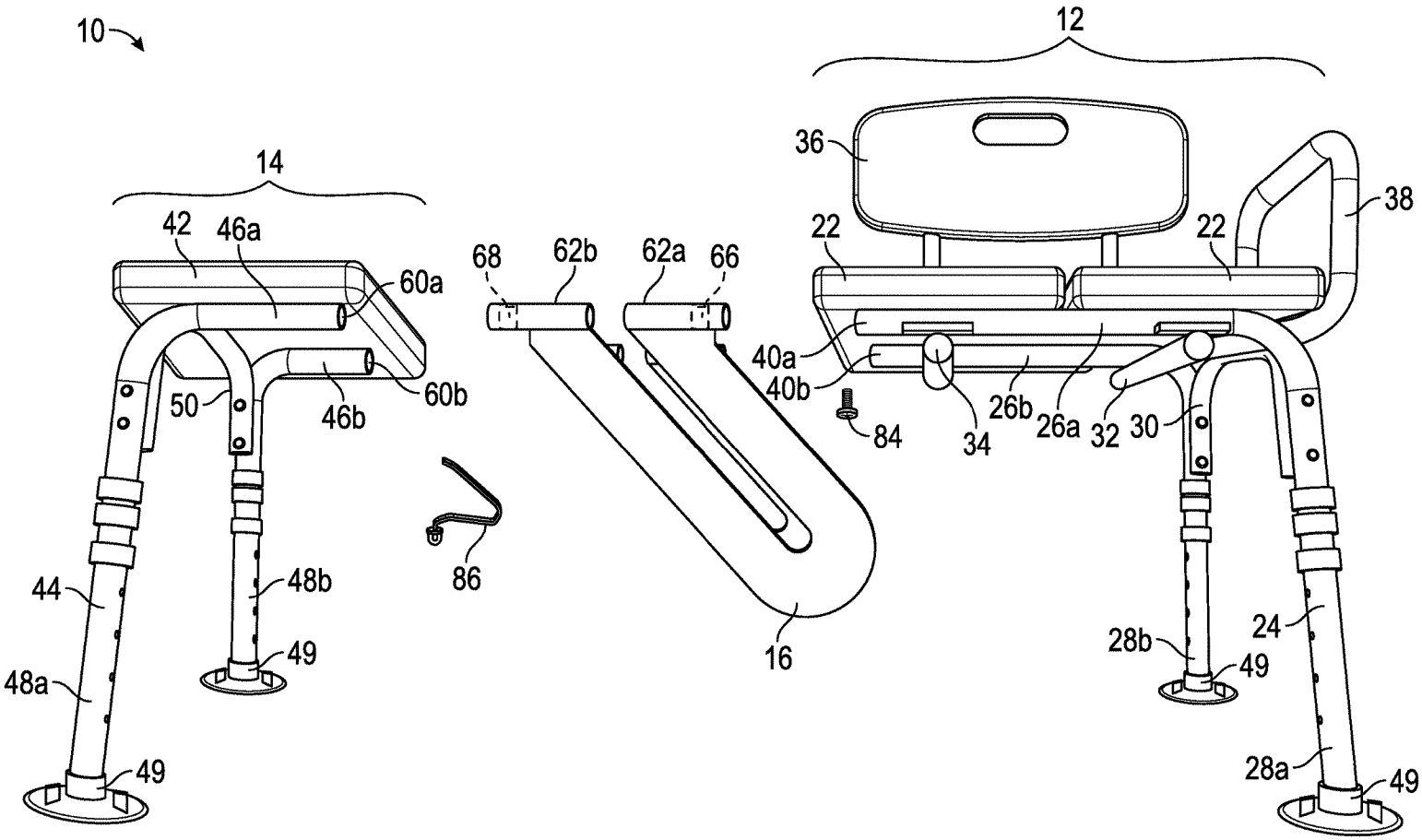
FIG. 2 is an exploded perspective view of the shower bench seat of FIG. 1.
Figure 4:
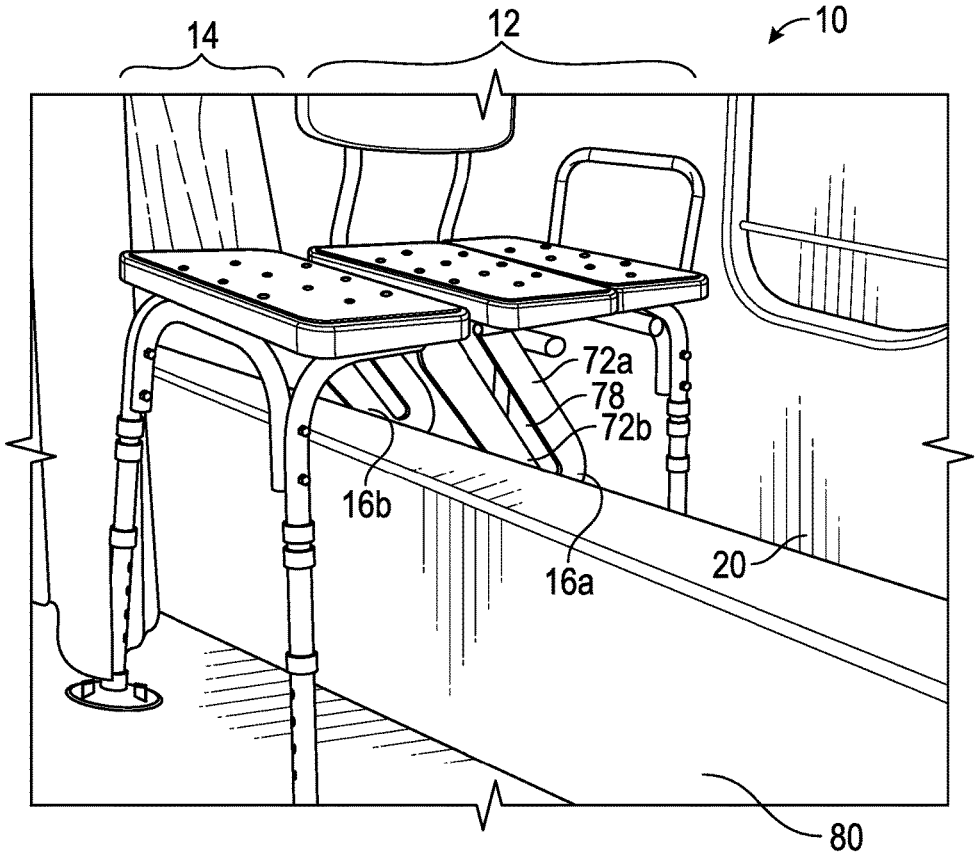
FIG. 4 is a perspective view of the shower bench seat of FIG. 1 shown in an installed position with a shower area.

Referring now to FIGS. 1, 2 and 4, a first embodiment of a shower bench seat is shown generally at 10. The shower bench seat 10 includes an inboard assembly 12, an outboard assembly 14 and a plurality of intermediate assemblies 16*a*, 16*b*. As shown in FIG. 4, generally the inboard assembly 12 is configured for placement within a shower area 20, the outboard assembly 14 is configured for placement in an area outside of the shower area 20 and the intermediate assemblies 16*a*, 16*b* connects the inboard assembly 12 to the outboard assembly 14.

Referring again to FIGS. 1, 2 and 4, the inboard assembly 12 includes one or more seat segments 22 supported by a first framework 24. The seat segments 22 are configured to support a person in a seated position within the shower area 20. In the illustrated embodiment, the seat segments 22 are formed from a substantially waterproof polymeric material. In alternate embodiments, the seat segments 22 can be formed from other materials, sufficient to support a person in a seated position within the shower area 20. While the embodiment illustrated in FIGS. 1 and 2 show a quantity of two seat segments 22, it should be appreciated that more or less than two seat segments can be used.

Referring again to FIGS. 1, 2 and 4, the seat segments 22 can have any desired shape, thickness, orientation and arrangement sufficient to support a person in a seated position within the shower area 20.

Referring again to FIGS. 1 and 2, the seat segments 22 are supported by the first framework 24. The first framework 24 includes a plurality of support arms 26*a*, 26*b* fastened to an underside of the seat segments 22. The support arms 26*a*, 26*b* extend from opposing legs 28*a*, 28*b*. The legs 28*a*, 28*b* extend from the support arms 26*a*, 26*b* to a floor surface (not shown). A cross-brace 30 connects the opposing legs 28*a*, 28*b* and a plurality of cross-braces 32, 34 connect the opposing support arms 26*a*, 26*b*. The cross-braces 30, 32 and 34 are configured to provide structural support to the inboard assembly 12. In the embodiment illustrated in FIGS. 1 and 2, the support arms 26*a*, 26*b*, opposing legs 28*a*, 28*b* and the cross-braces 30, 32 and 34 are formed from hollow, metallic tubing. In alternate embodiments, the support arms 26*a*, 26*b*, opposing legs 28*a*, 28*b* and the cross-braces 30, 32 and 34 can be formed from other materials sufficient to provide structural support to the inboard assembly 12.

Referring again to FIGS. 1 and 2, optionally, the inboard assembly 12 can include one or more backrests 36 and one or more grab rails 38. The backrest 36 is configured to provide support for a person's back when the person is seated on the seat segments 22. The grab rails 38 are configured to provide a hand grip for steadying a person using the shower bench seat 10. The backrest 36 and the grab rails 38 can have any desired structure, orientation, quantity, shape and size sufficient to provide support for a person's back when the person is seated on the seat segments 22. However, it should be appreciated that the backrest 36 and the grab rails 38 are optional and not required for operation of the shower bench seat 10.

Referring now to FIG. 2, a first end 40*a* of the support arm 26*a* forms a cavity (not shown) within the hollow portion of the support arm 26*a*. In a similar manner, a second end 40*b* of the support arm 26*b* forms a cavity (not shown) within the hollow portion of the support arm 26*b*. The cavities formed within the support arms 26*a*, 26*b* will be discussed in more detail below.

Referring again to FIGS. 1 and 2, the outboard assembly 14 includes one or more seat segments 42 supported by a second framework 44. In the illustrated embodiment, the seat segments 42 are the same as, or similar to, the seat segments 22 described above and shown in FIGS. 1 and 2. However, in other embodiments, the seat segments 42 can be different from the seat segments 22.

Referring again to FIGS. 1 and 2, the second framework 44 includes a plurality of support arms 46*a*, 46*b* fastened to an underside of the seat segment 42. The support arms 46*a*, 46*b* extend from opposing legs 48*a*, 48*b*. The legs 48*a*, 48*b* extend from the support arms 46*a*, 46*b* to a floor surface (not shown). A cross-brace 50 connects the opposing legs 48*a*, 48*b*. In the illustrated embodiment, the support arms 46*a*, 46*b*, legs 48*a*, 48*b* and the cross-brace 50 are the same as, or similar to, the support arms 26*a*, 26*b*, legs 28*a*, 28*b* and the cross-brace 30 described above and shown in FIGS. 1 and 2. However, in other embodiments, the support arms 46*a*, 46*b*, legs 48*a*, 48*b* and the cross-brace 50 can be different from the support arms 26*a*, 26*b*, legs 28*a*, 28*b* and the cross-brace 30.

Referring again to FIG. 2, the legs 28*a*, 28*b*, 48*a* and 48*b* can be fitted with feet 49. The feet 49 are configured to provide a slip-resistant connection between the shower bench seat 10 and the floor surface. The feet 49 can be formed any desired material and can have any desired shape, size and structure, sufficient to provide a slip-resistant connection between the shower bench seat 10 and the floor surface.

Referring now to FIG. 2, a first end 60*a* of the support arm 46*a* forms a cavity (not shown) within the hollow portion of the support arm 46*a*. In a similar manner, a second end 60*b* of the support arm 46*b* forms a cavity (not shown) within the hollow portion of the support arm 46*b*. The cavities formed within the support arms 46*a*, 46*b* will be discussed in more detail below.

Referring again to FIGS. 1, 2 and 4, the intermediate assemblies 16*a*, 16*b* are configured for several functions. First, the intermediate assemblies 16*a*, 16*b* are configured to connect the inboard assembly 12 to the outboard assembly 14. Second, the intermediate assemblies 16*a*, 16*b* are configured to receive a shower curtain such that the shower curtain can extend across an opening to the shower area 20, thereby closing off the opening and retaining water within the shower area 20.

Figure 3A:
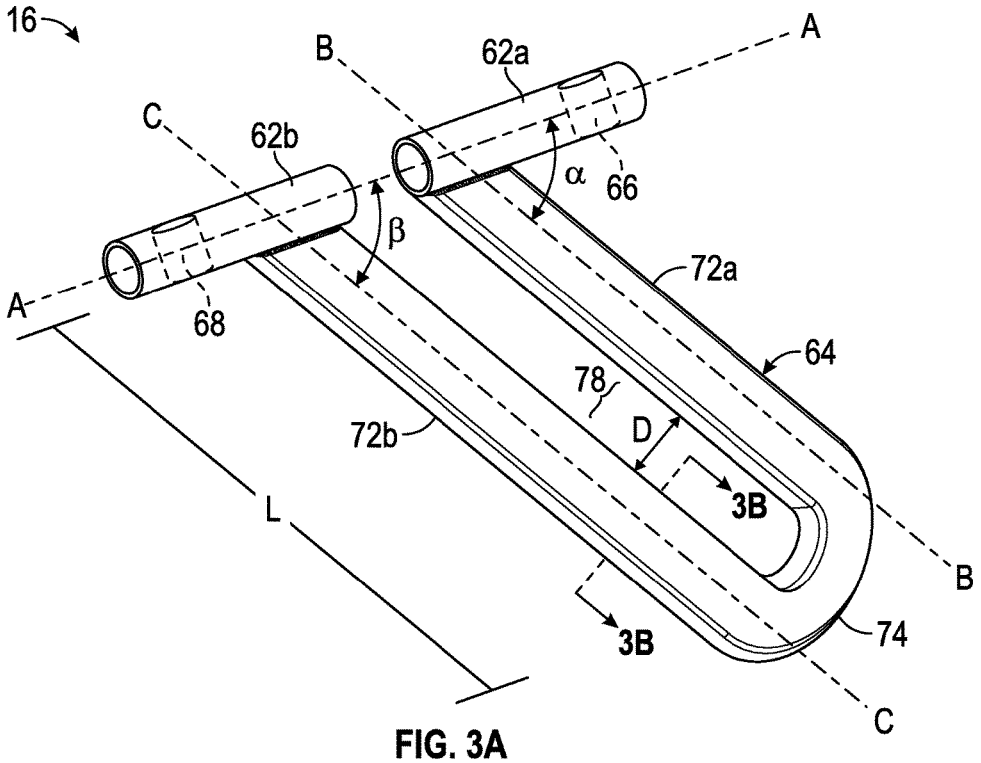
FIG. 3A is a perspective view of an intermediate assembly of the shower bench seat of FIG. 1.

Referring now to FIGS. 1, 2 and 3A, the intermediate assembly 16*a* is illustrated. The intermediate assembly 16*a* is representative of the intermediate assembly 16*b* and includes a first connector arm 62*a*, a second connector arm 62*b* and an extension assembly 64 extending therebetween. The first connector arm 62*a* is configured for insertion into the cavity formed in the first end 40*a* of the support arm 26*a* of the inboard assembly 12. In the illustrated embodiment, the outside diameter of the first connector arm 62*a* closely approximates the inside diameter of the support arm 26*a*, thereby providing a close sliding fit between the first connector arm 62*a* and the support arm 26*a*. The second connector arm 62*b* is configured for insertion into the cavity formed in the first end 60*a* of the support arm 46*a* of the outboard assembly 14. In the illustrated embodiment, the outside diameter of the second connector arm 62*b* closely approximates the inside diameter of the support arm 46*a*, thereby providing a close sliding fit between the first connector arm 62*b* and the support arm 46*a*.

Referring again to FIG. 3A, the first connector arm 62*a* includes an aperture 66 extending there through. The aperture 66 has a substantially vertical orientation. In a similar manner, the second connector arm 62*b* includes an aperture 68 extending there through. The aperture 68 also has a substantially vertical orientation. The apertures 66, 68 will be discussed in more detail below.

In the embodiment illustrated in FIG. 3A, the first and second connector arms 62*a*, 62*b* are formed from hollow, metallic tubing. In alternate embodiments, the first and second connector arms 62*a*, 62*b* can be formed from other materials sufficient for insertion into the cavities formed in the support arms 26*a*, 46*a*.

Referring again to the embodiment illustrated in FIG. 3A, the first and second connector arms 62*a*, 62*b* are axially aligned along axis A-A.

Referring again to FIGS. 3A and 4, the extension assembly 64 includes a first segment 72*a*, a second segment 72*b* and a connector segment 74. The first segment 72*a* is centered about a longitudinal axis B-B and the second segment 72*b* is centered about a longitudinal axis C-C. The longitudinal axis B-B forms an angle α with the axis A-A and the longitudinal axis C-C forms an angle β with the axis A-A. Referring now to FIG. 4, the angles α, β are configured to form angled first and second segments 72*a*, 72*b*, thereby allowing a majority of the inboard assembly 12 to be positioned in the shower area 20. Referring again to the embodiment shown in FIG. 3A, angles α, β are in a range of from about 40° to about 60°. However, in other embodiments, the angles α, β can be less than about 40° or more than about 60°, sufficient to form angled first and second segments 72*a*, 72*b*, thereby allowing a majority of the inboard assembly 12 to be positioned in the shower area 20. It is also within the contemplation of the shower bench seat that the angles α, β could be 90° or more, thereby positioning the first and second segments 72*a*, 72*b* at substantially vertical orientations, thereby allowing the entirety of the inboard assembly 12 to be positioned in the shower area 20.

Referring again to the embodiment illustrated in FIGS. 3A and 4, the angles α, β are equal to each other such that the first and second segments 72*a*, 72*b* are parallel to each other. However, in other embodiments, the angles α, β can be different to each other, such that the first and second segments 72*a*, 72*b* have a non-parallel orientation, sufficient to form angled first and second segments 72*a*, 72*b* and allow a majority of the inboard assembly 12 to be positioned in the shower area 20.

Referring again to FIGS. 3A and 4, the first and second segments 72*a*, 72*b* are spaced apart a distance D. The distance D is configured to form a gap 78. As will be explained in more detail below, the gap 78 is configured to receive a portion of a shower curtain such that the shower curtain can extend across an opening to the shower area 20 and close off the opening to retain water within the shower area 20. In the illustrated embodiment, the distance D is in a range of from about 2.0 inches to about 4.0 inches. In alternate embodiments, the distance D can be less than about 2.0 inches or more than about 4.0 inches, sufficient to receive a portion of a shower curtain such that the shower curtain can extend across an opening to the shower area 20 and close off the opening to retain water within the shower area 20.

Referring again to the embodiment shown in FIGS. 3A and 4, the distance D is uniform along the length of the first and second segments 72*a*, 72*b*. However, it is further contemplated that in other embodiments the distance D can vary along the lengths of the first and second segments 72*a*, 72*b*, sufficient to receive a portion of a shower curtain such that the shower curtain can extend across an opening to the shower area 20 and close off the opening to retain water within the shower area 20.

Referring again to FIGS. 3A and 4, the gap 78 has a length L. The length L is configured such that the gap 78 can receive a portion of a shower curtain, thereby allowing the shower curtain to extend across and close off an opening to the shower area 20 to retain water within the shower area 20. In the illustrated embodiment, the length L is in a range of from about 6.0 inches to about 12.0 inches. It is contemplated that in other embodiments, the length L can be less than about 6.0 inches or more than about 12.0 inches, sufficient that such that the gap 78 can receive a portion of a shower curtain, thereby allowing the shower curtain to extend across and close off an opening to the shower area 20 to retain water within the shower area 20.

Figure 3B:
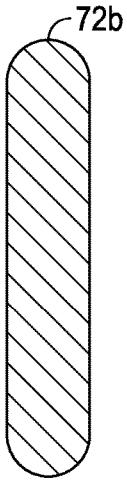
FIG. 3B is a cross-sectional view, taken along the lines 3B-3B, of a first segment of the intermediate assembly of FIG. 3A.
Figure 3C:
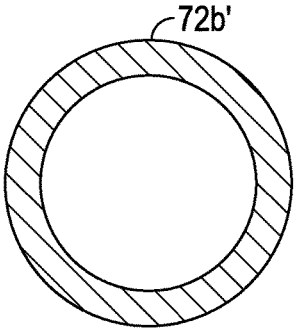
FIG. 3C is a cross-sectional view of a second embodiment of the first segment of the intermediate assembly of FIG. 3A.

Referring now to FIGS. 3B and 4, the first and second segments 72*a*, 72*b* and the connector segment 74 are formed from a solid metallic material having a cross-sectional shape of a rectangle with rounded ends. In other embodiments, the first and second segments 72*a*, 72*b* and the connector segment 74 can be formed from other materials, such as the non-limiting example of polymeric materials and can have other cross-sectional shapes, sufficient to receive a portion of a shower curtain such that the shower curtain can extend across an opening to the shower area 20 and close off the opening to retain water within the shower area 20. One non-limiting example of an alternate material forming the first and second segments 72*a*, 72*b* and the connector segment 74 is illustrated in FIG. 3C. In this embodiment, the second segment 72*b*' is shown as being formed from the same material as used to form the first and second connector arms 62*a*, 62*b*, that is, hollow, metallic tubing. While the embodiment of the second segment 72*b*' is illustrated in FIG. 3C as a hollow structure, it should be appreciated that in other embodiments, the second segment 72*b*' can be a solid structure or a structure incorporating both hollow and solid elements.

Referring again to FIG. 2, once the first connector arm 62*a* is inserted into the cavity formed in the first end 40*a* of the support arm 26*a* of the inboard assembly 12 as described above, a fastener 84 is inserted through the aperture 66 in the first connector arm 62*a* and a corresponding aperture (not shown) in the support arm 26*a*. The fastener 84 is subsequently attached to a seat segment 22. In the illustrated embodiment, the fastener 84 is a sheet metal screw. However, in other embodiments, the fastener 84 can be other structures sufficient to attach the first connector arm 62*a* of the intermediate assembly 16 to the inboard assembly 12.

Referring again to FIG. 2, once the second connector arm 62*b* is inserted into the cavity formed in the first end 60*a* of the support arm 46*a* of the outboard assembly 14 as described above, a fastener 86 is inserted through the aperture 68 in the second connector arm 62*b* and through a corresponding aperture (not shown) in the support arm 46*a* such as to attach the second connector arm 62*b* to the support arm 46*a*. In the illustrated embodiment, the fastener 86 is a push pin connector, as is known in the art. Use of the push pin connector advantageously facilitates easy assembly and disassembly of the inboard and outboard assemblies 12, 14. It should be appreciated that in other embodiments, other fasteners can be used to connect the outboard assembly 14 to the intermediate assembly, including the use of fasteners providing a more permanent connection.

Referring again to FIG. 4, the shower bench seat 10 is shown in an installed positioned. The inboard assembly 12 is substantially positioned within the shower area 20, the outboard assembly 14 is positioned adjacent the shower area 20 and the intermediate assemblies 16*a*, 16*b* connect the inboard assembly 12 to the outboard assembly 14. In this position, the gap 78 formed by the first and second segments 72*a*, 72*b* of each of the intermediate assemblies 16*a*, 16*b* are also positioned within the shower area 20.

Figure 5A:
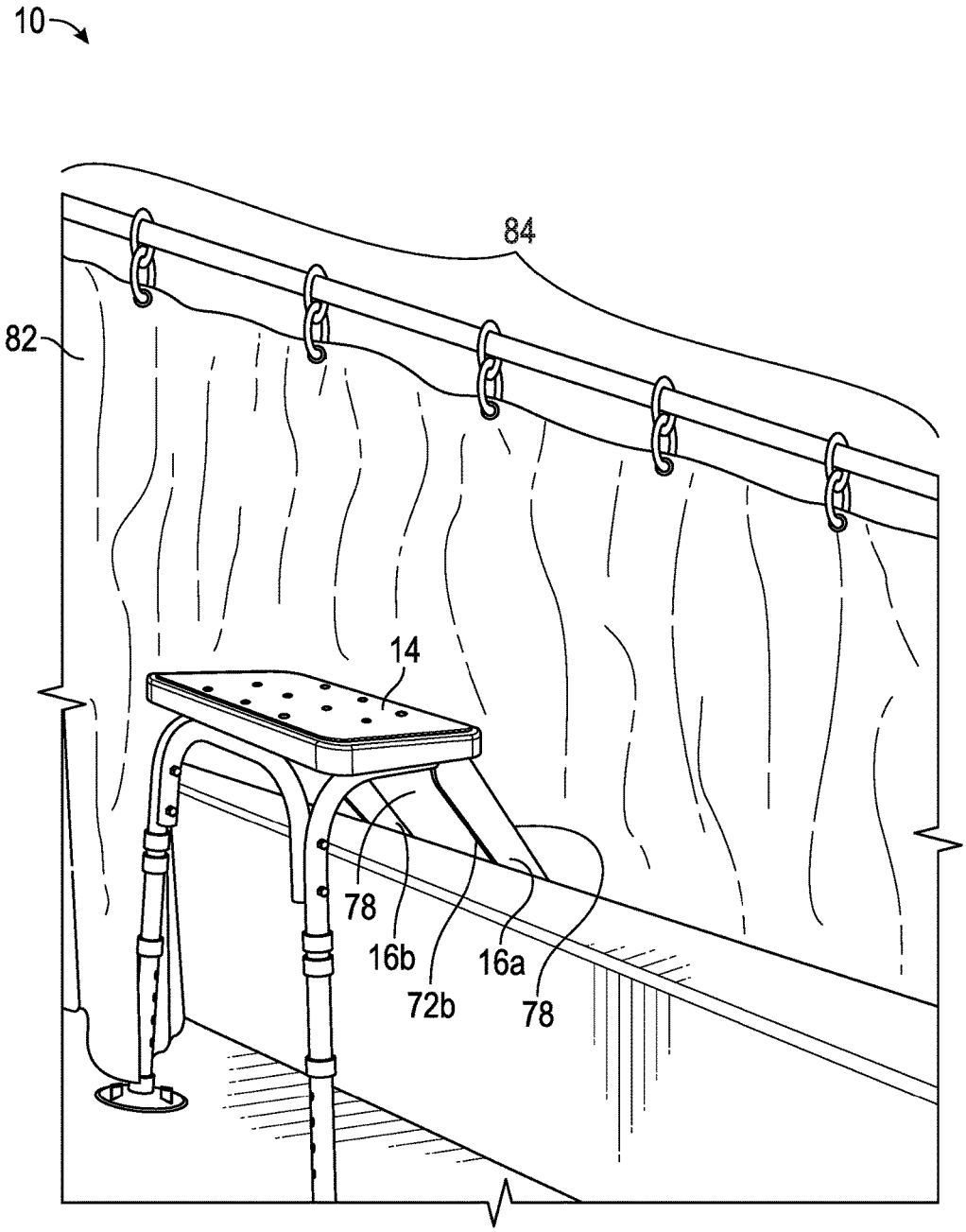
FIG. 5A is a perspective view of the shower bench seat of FIG. 1 shown in an installed position with a shower area with a shower curtain extended across the shower area.
Figure 5B:
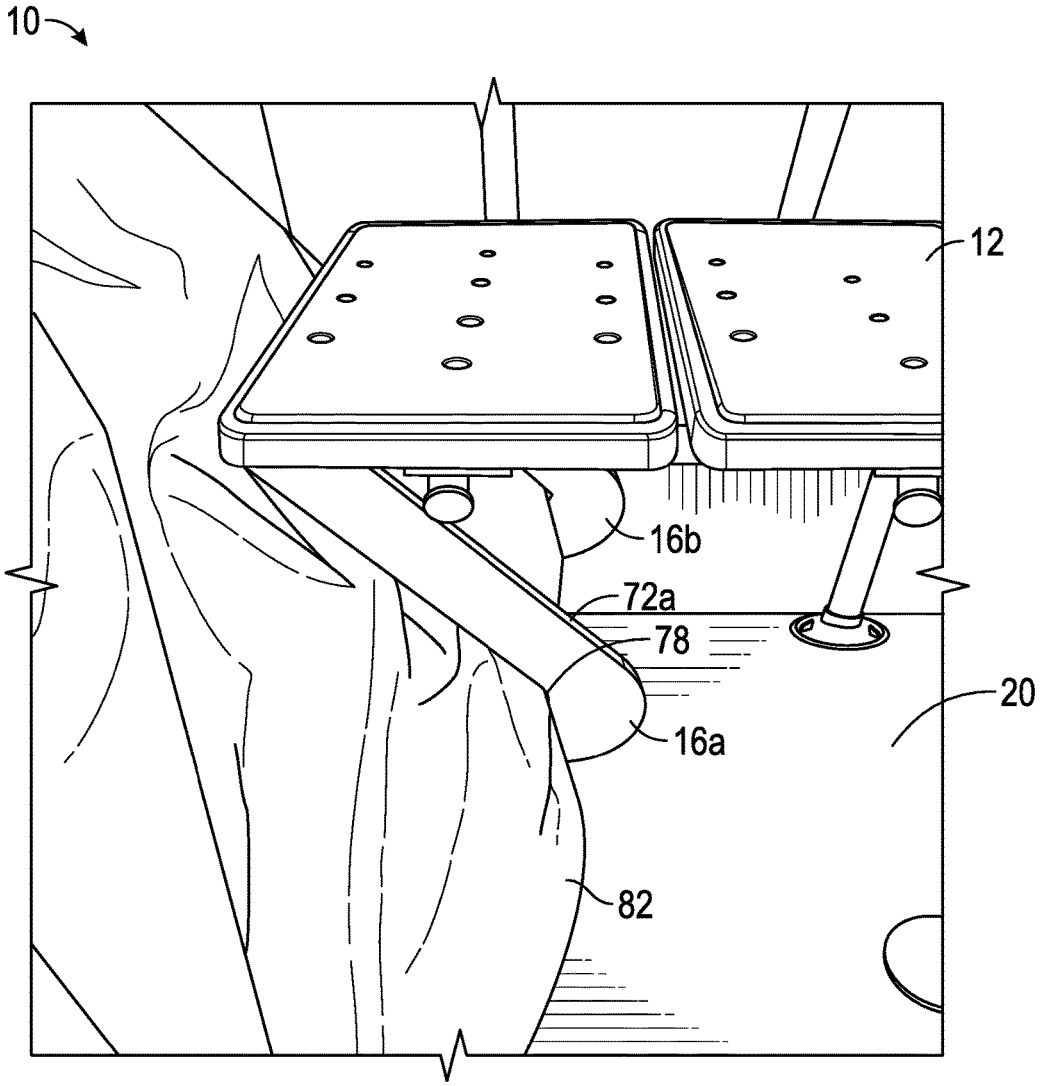
FIG. 5B is a perspective view of the shower bench seat of FIG. 1 shown in an installed position with a portion of the shower area inserted into the intermediate assembly.

Referring now to FIGS. 4, 5A and 5B, the shower bench seat 10 is further shown in an installed positioned. The inboard assembly 12 is substantially positioned within the shower area 20, the outboard assembly 14 is positioned adjacent the shower area 20 and the intermediate assemblies 16*a*, 16*b* connect the inboard assembly 12 to the outboard assembly 14. In this position, the gaps 78 formed by the first and second segments 72*a*, 72*b* of each of the intermediate assemblies 16*a*, 16*b* are also positioned within the shower area 20. A portion of shower curtain 82 is inserted into the gaps 78 such that the shower curtain 82 can extend across an opening 84 to the shower area 20. With the shower curtain 82 extended across the opening 84 and a portion of the shower curtain 82 positioned within the gaps 78 of the shower bench seat 10, the shower bench seat can be advantageously used to support a person in a seated position within the shower area 20 and simultaneously close off the opening 84 to retain water within the shower area 20.

While the embodiment illustrated in FIGS. 4 and 5A show a shower area 20 having a tub wall 80, it should be appreciated that in other embodiments the shower bench seat 10 can be adapted for use with shower areas 20 absent a tub wall 80.

The principle and mode of operation of the shower bench seat have been described in certain embodiments. However, it should be noted that the shower bench seat may be practiced otherwise than as specifically illustrated and described without departing from its scope.

What is claimed is:

1. A shower bench seat configured for use in a shower area, the shower bench seat comprising:

an inboard assembly configured for placement within the shower area;

an outboard assembly configured for placement adjacent the shower area, the outboard assembly having a plurality of legs extending therefrom and the plurality of legs are in contact with a floor section adjacent the shower area; and an intermediate assembly configured to connect the inboard assembly to the outboard assembly, wherein the intermediate assembly extends in a downward direction away from the outboard assembly, the intermediate assembly forming an angle with the inboard assembly in a range of about 40° to about 60°, and wherein the intermediate assembly further includes an elongated gap configured to receive a shower curtain within the shower area thereby facilitating use of the shower bench seat by a user in a seated position and simultaneously facilitating retention of water within the shower area.

2. The shower bench seat of claim 1, wherein the intermediate assembly includes a plurality of segments extending from connector arms.

3. The shower bench seat of claim 2, wherein the plurality of segments extend at an angle from the connector arms in a range of from about 40° to about 60°.

4. The shower bench seat of claim 2, wherein longitudinal axes of the segments are substantially parallel to each other.

5. The shower bench seat of claim 2, wherein the connector arms are formed from tubular materials.

6. The shower bench seat of claim 2, wherein the plurality of segments are formed from materials having the cross-sectional shape of a rectangle with rounded ends.

7. The shower bench seat of claim 1, wherein portions of the intermediate assembly are configured for insertion into portions of the inboard assembly.

8. The shower bench seat of claim 1, wherein portions of the intermediate assembly are configured for insertion into portions of the outboard assembly.

9. The shower bench seat of claim 2, wherein plurality of segments of the intermediate assembly are spaced apart by a distance in a range of from about 2.0 inches to about 4.0 inches.

10. The shower bench seat of claim 9, wherein the spaced apart distance between the plurality of segments is constant along the length of the segments.

11. A method of using a shower bench seat configured for use in a shower area, the method comprising the steps of:

positioning a substantial portion of an inboard assembly within the shower area;

positioning an outboard assembly adjacent to the shower area, the outboard assembly having a plurality of legs extending therefrom and the plurality of legs are in contact with a floor section adjacent the shower area;

connecting the inboard assembly to the outboard assembly with an intermediate assembly, the intermediate assembly extending in a downward direction away from the outboard assembly and positioned within the shower area, the intermediate assembly extending at an angle from the inboard assembly in a range of about 40° to about 60° and including an elongated gap configured to receive a shower curtain; and inserting a portion of a shower curtain into the elongated gap of the intermediate assembly such that the shower curtain extends across a shower opening and a user can use the shower bench seat in a seated position.

12. The method of claim 11, including the step of forming the intermediate assembly by extending a plurality of segments from connector arms.

13. The method of claim 12, wherein the plurality of segments extend at an angle from the connector arms in a range of from about 40° to about 60°.

14. The method of claim 12, wherein longitudinal axes of the segments are substantially parallel to each other.

15. The method of claim 12, including the step of forming the connector arms from tubular materials.

16. The method of claim 12, including the step of forming the plurality of segments from materials having the cross-sectional shape of a rectangle with rounded ends.

17. The method of claim 11, including the step of inserting portions of the intermediate assembly into portions of the inboard assembly.

18. The method of claim 11, including the step of inserting portions of the intermediate assembly into portions of the outboard assembly.

19. The method of claim 18, including the step of attaching the intermediate assembly to the outboard assembly with a push pin connector.

20. The method of claim 12, including the step of spacing the plurality of segments apart by a distance in a range of from about 2.0 inches to about 4.0 inches.

* * * * *